US010251419B2

(12) United States Patent
Camitta

(10) Patent No.: US 10,251,419 B2
(45) Date of Patent: Apr. 9, 2019

(54) WATER FILTER CONFIGURED TO RECEIVE A ROLLED PRODUCT

(71) Applicant: MJ's Arsenal LLC, Denver, CO (US)

(72) Inventor: Josh Camitta, Denver, CO (US)

(73) Assignee: MJ'S ARSENAL LLC, Denver, CO (US)

( * ) Notice: Subject to any disclaimer, the term of this patent is extended or adjusted under 35 U.S.C. 154(b) by 0 days.

(21) Appl. No.: 15/796,623

(22) Filed: Oct. 27, 2017

(65) Prior Publication Data

US 2018/0263280 A1 Sep. 20, 2018

Related U.S. Application Data

(60) Provisional application No. 62/473,279, filed on Mar. 17, 2017.

(51) Int. Cl.
*A24F 13/06* (2006.01)

(52) U.S. Cl.
CPC ..... *A24F 13/06* (2013.01)

(58) Field of Classification Search
None
See application file for complete search history.

(56) References Cited

U.S. PATENT DOCUMENTS 1,505,861 A * 8/1924 Carafilidis ..... A24F 1/30 131/173
1,858,180 A * 5/1932 Bjornstad ..... A24F 13/14 131/175
3,394,710 A 7/1968 Ping-Chuan
3,410,281 A 11/1968 Ephron et al.
4,071,035 A * 1/1978 Boyd ..... A24F 1/30 131/173
4,096,868 A * 6/1978 Norman ..... A24F 1/30 131/173
4,165,753 A * 8/1979 Stryker ..... A24F 1/30 131/173
4,638,815 A 1/1987 Yoshioka
4,648,410 A 3/1987 Seroussi
5,458,106 A 10/1995 Kim
5,476,110 A 12/1995 Baig et al.
6,568,400 B1 5/2003 Tinsky et al.
8,205,621 B1 * 6/2012 Seeley ..... A24F 13/04 131/272

(Continued)

FOREIGN PATENT DOCUMENTS

CA 2561331 3/2008
DE 10106396 A1 * 8/2002 ..... A24F 1/30
GB 1173848 12/1969

(Continued)

OTHER PUBLICATIONS

English machine translation of DE 10106396.*

*Primary Examiner* — Michael J Felton
*Assistant Examiner* — Katherine A Will
(74) *Attorney, Agent, or Firm* — Brownstein Hyatt Farber Schreck, LLP

(57) ABSTRACT

A water filter for filtering smoke produced by a burned or combusted product. The water filter includes a receptacle configured to receive a rolled product that may be burned, combusted, or vaporized. The water filter includes an integrated downtube configured to deliver smoke from the rolled product into a water reservoir prior to inhalation.

18 Claims, 12 Drawing Sheets

(56) References Cited

U.S. PATENT DOCUMENTS

| | | | | |
|---|---|---|---|---|
| 2014/0326256 | A1 | 11/2014 | McKay | |
| 2016/0095351 | A1* | 4/2016 | Carrion | A24F 1/30<br>131/173 |

FOREIGN PATENT DOCUMENTS

| | | |
|---|---|---|
| GB | 1274168 | 5/1972 |
| WO | WO2001/074184 | 10/2001 |

* cited by examiner

WATER FILTER CONFIGURED TO RECEIVE A ROLLED PRODUCT

CROSS-REFERENCE TO RELATED APPLICATION(S)

This application is a nonprovisional patent application of and claims the benefit of U.S. Provisional Patent Application No. 62/473,279, filed Mar. 17, 2017 and titled "Water Filter Configured to Receive a Rolled Product," the disclosure of which is hereby incorporated herein by reference in its entirety.

FIELD

The described embodiments relate generally to water filters. More particularly, the present embodiments relate to a water filter that is configured to receive a rolled product.

BACKGROUND

Tobacco and other combustible products may typically be ingested through combustion and inhalation of the resulting smoke. Such smoke may be passed through a filtering method and/or a cooling method prior to entering the user's body. For instance, a cigarette may include a filter made from cellulose acetate fiber, paper, or activated charcoal, which may filter particulates in the smoke from burning tobacco.

Some traditional products, like hookahs, pull smoke from a metal cup through water or another type of liquid prior to inhalation. However, traditional hookahs are bulky and can be difficult to transport. Additionally, traditional hookahs are generally not configured to accept a rolled product, such as a cigarette. The following disclosure is directed to devices that overcome some of these limitations with traditional products or devices.

SUMMARY

Embodiments described herein generally relate to a water filter or water pipe for inhaling a combustible product, such as tobacco. The water filter may be specially configured to receive a rolled product, such as a rolled cigarette, and may accommodate various sizes and shapes of cigarettes. In some embodiments, the water pipe includes a vessel body, a mouthpiece, a cigarette receptacle, and a downtube.

The vessel body may include an outer wall defining an internal water reservoir. The mouthpiece includes an opening through the outer wall of the vessel body and is positioned on an upper portion of the vessel body. The cigarette receptacle is designed to hold a rolled cigarette and delivers smoke into a lower portion of the water reservoir. The downtube couples to the cigarette receptacle. In some implementations, the downtube includes a chamber which is formed with the outer wall of the vessel body.

Some example embodiments are directed to a water filter having a vessel body including defining an internal cavity configured to retain a liquid. The water filter also includes a mouthpiece that is integrally formed and positioned on an upper portion of the vessel body and defining an opening through the outer wall. A receptacle is integrally formed with the vessel body and is configured to hold a rolled product. The water filter also includes a downtube that extends from the receptacle and into the internal cavity. The downtube is configured to direct combusted or vaporized material from the rolled product into the retained liquid. In some instances, the vessel body defines a carburation port positioned above the receptacle. In some implementations, the vessel body, the mouthpiece, and the receptacle are integrally formed from a glass material. In some implementations, the vessel body, the mouthpiece, and the receptacle are integrally formed from a silicone material.

In some embodiments, the receptacle defines a conical surface. The conical surface may be configured to form a seal between the rolled product and the receptacle. In some implementations, the conical surface has an interior angle that ranges between 5 and 10 degrees.

In some embodiments, the receptacle defines a tapered surface having a first diameter at an outer end and a second diameter at an inner end. The first diameter may range between 10 mm and 20 mm. The second diameter is less than the first diameter and may range between 2 mm and 9 mm. The distance between the outer end and the inner end may be approximately 10 mm to 25 mm. In some cases, the first diameter may range between 12 and 16 mm, and the second diameter ranges between 3 mm and 6 mm. In some implementations, the tapered surface has a sand blasted surface finish that facilitates the seal between the rolled product and the receptacle.

The water filter may be configured to be held in a user's hand and the carburation port may be positioned above the receptacle by a distance that enables the carburation port to be covered by an index finger of the user's hand when the vessel body is being held.

In some cases, the downtube is formed from a glass material and the vessel body is formed from the same glass material. In some implementations, the downtube is integrally formed with the vessel body.

Some example embodiments are directed to a water filter having a vessel body that defines an internal cavity configured to hold water in a lower region of the vessel body. The water filter may also include a mouthpiece that is coupled to an upper portion of the vessel body and defines an opening that extends into the internal cavity. The water filter may also include a receptacle formed integral with the vessel body and configured to receive a rolled product. A downtube may be coupled to the receptacle and have an outlet that is configured to be submerged by the water in the lower region of the vessel body.

The water filter may also include a carburation port defining an aperture in the glass vessel body positioned between the receptacle and a top of the glass vessel body. In some cases, the downtube includes an internal passage configured to transfer smoke or vaporized product from the receptacle. The passage may be defined, in part, by an inner portion of the sidewall of the glass vessel body.

In some implementations, the receptacle defines a conical section that is configured to receive the rolled product. The conical section may define a first internal diameter at an opening of the receptacle and a second internal diameter located inward of the opening of the receptacle proximate to the vessel body. The first internal diameter may range between 10 and 20 mm, and the second internal diameter is less than the first diameter and ranges between 2 mm and 9 mm. In some cases, the first internal diameter may range between 12 and 16 mm, and the second internal diameter ranges between 3 mm and 6 mm.

In some implementations, the conical section includes a textured surface configured to facilitate a seal between the rolled product and the conical section. The conical section may have an interior angle that ranges between 5 and 10 degrees.

In some example embodiments, the vessel body includes an outer wall that defines the internal cavity. The downtube may include or define a chamber that is configured to receive combusted or vaporized product from the rolled product that passes through the receptacle. The chamber may be defined, in part, by the outer wall of the vessel body. The chamber may also include a chamber wall that defines the outlet that is submerged by the water in the lower region of the vessel body.

Some example embodiments are directed to a water filter having a glass vessel body having a sidewall defining an internal cavity that is configured to hold water. The water filter may also include a mouthpiece that is coupled to the glass vessel body and defines an opening into an upper portion of the internal cavity. The water filter may also include a receptacle integrated with the glass vessel body and defining a tapered surface that is configured to form a seal between the rolled product and the receptacle. A downtube extends into the internal cavity and is configured to transfer smoke or vaporized product from the receptacle to the water.

In some embodiments, the rolled product includes an end portion having a taper angle. The tapered surface of the receptacle may have an internal angle that is greater than the taper angle of the rolled product. In some implementations, the tapered surface defines a first internal diameter ranging between 10 mm and 20 mm and a second internal diameter ranging between 2 mm and 9 mm.

BRIEF DESCRIPTION OF THE DRAWINGS

The disclosure will be readily understood by the following detailed description in conjunction with the accompanying drawings, wherein like reference numerals designate like elements.

Figure 1A:
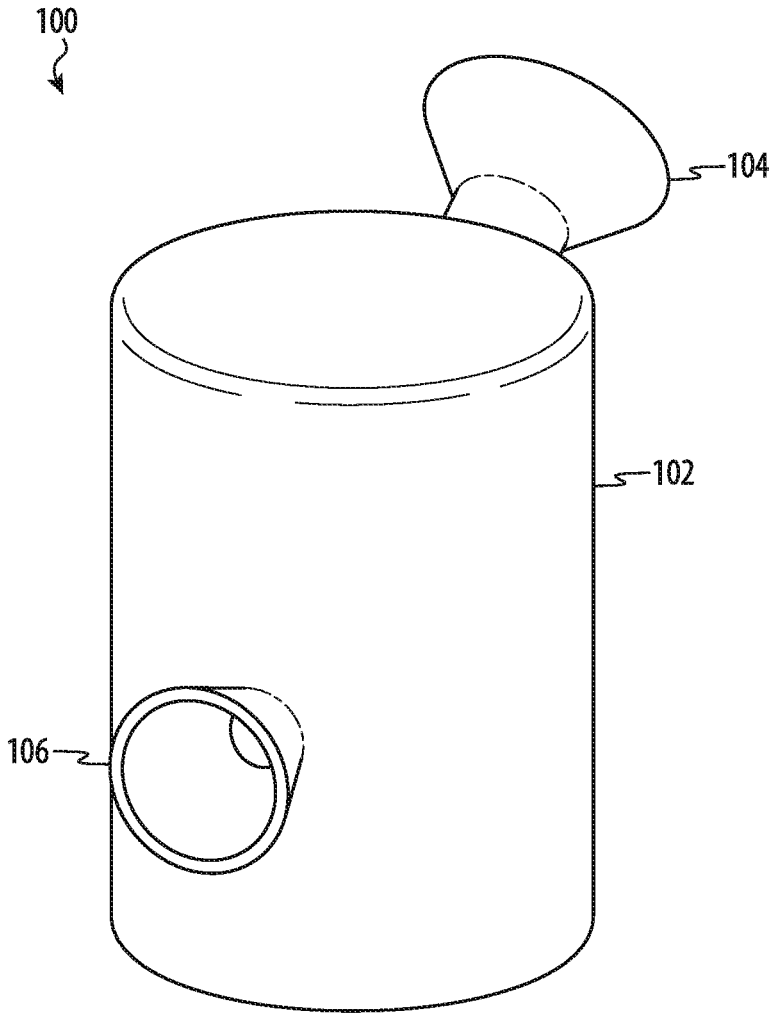
FIG. 1A depicts a first example of a water pipe according to the present disclosure.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments illustrated in the accompanying drawings. It should be understood that the following descriptions are not intended to limit the embodiments to one preferred implementation. To the contrary, the described embodiments are intended to cover alternatives, modifications, and equivalents as can be included within the spirit and scope of the disclosure and as defined by the appended claims.

The following disclosure relates to a water filter or water pipe for smoking tobacco, a combustible product, and/or a vaporized product. In particular, the water filter or water pipe may be configured to receive a rolled product, such as a cigarette. The water filter or water pipe includes a vessel body that defines a water reservoir which holds water or another liquid for filtration and/or cooling smoke prior to inhalation by a user. The water reservoir is typically partially filled with liquid, such that smoke which passes through the water is held within the reservoir above the water level. A specially designed receptacle for the rolled product (e.g., a cigarette) is coupled to or integrally formed with the vessel body. The receptacle may include a tapered or conical surface that is configured to hold the rolled product and form a seal between the rolled product and the receptacle. A mouthpiece may be coupled to or integrally formed with the vessel body and may be configured to allow a user to draw smoke or a vaporized product into the user's mouth after it has passed through the water.

Where some traditional products include a bowl or cup for holding combustible products, embodiments of the present disclosure include a receptacle shaped to receive a rolled product (e.g., a cigarette). The receptacle may be attached to or integrally formed with the vessel body such that a cigarette will typically be held parallel or inclined with respect to a horizontal plane when in use. The receptacle may have a conical shape, define a conical surface, or have a tapered opening that is specially configured to receive a rolled product. In some cases, the receptacle is configured to receive rolled product that may vary in size and shape. The rolled product may be placed within the receptacle and form a seal with the water reservoir. In some embodiments, the receptacle may also be textured to facilitate the formation of a seal when a cigarette is placed within the receptacle.

A downtube may be functionally coupled to the cigarette receptacle in order to pass smoke or vaporized product into the water held in the reservoir of the vessel body. Thus, as the downtube fills with smoke from a cigarette, the smoke or vaporized product will begin to pass through the water and into an upper portion of the water reservoir. Negative pressure may be created within the water reservoir, further drawing smoke through the water and into the reservoir. Once smoke or vaporized product enters the reservoir, the user may inhale the smoke through the mouthpiece.

In a particular embodiment, the downtube is formed integral with the vessel body. The vessel body may include one or more outer walls, and an outer wall may form a portion of the downtube. Such an embodiment may provide a simpler and/or more durable water pipe design with fewer separate parts. In some cases, the vessel body, the cigarette receptacle, and the downtube are integrally formed from a single material, such as glass or other ceramic.

In many embodiments, the disclosed water pipe may be small enough to be easily held within an average adult hand. The water pipe may accordingly be more portable, being easily carried by hand, within a pocket, on a necklace or keychain, or a similar method. An attachment point may be provided to facilitate attachment of the water pipe to another object, such as a necklace.

These and other embodiments are discussed below with reference to FIGS. 1A-6C. However, those skilled in the art will readily appreciate that the detailed description given herein with respect to these figures is for explanatory purposes only and should not be construed as limiting.

Figure 1B:
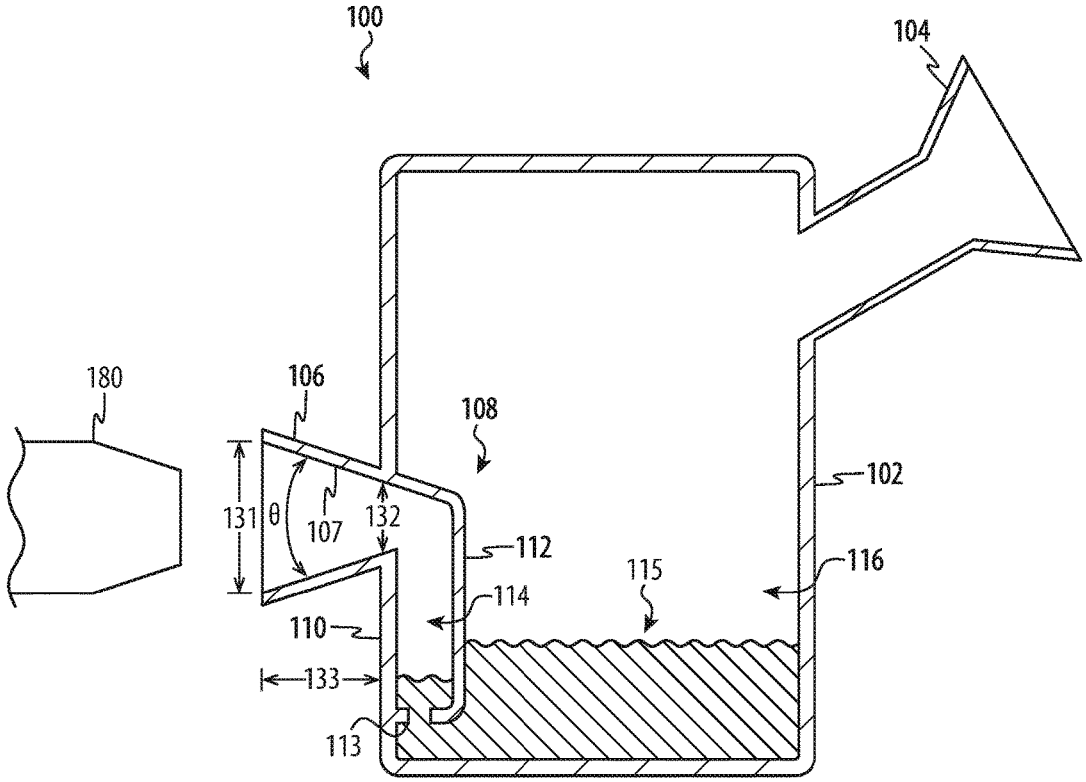
FIG. 1B depicts an example cross-sectional view of the water pipe of FIG. 1A.
Figure 1C:
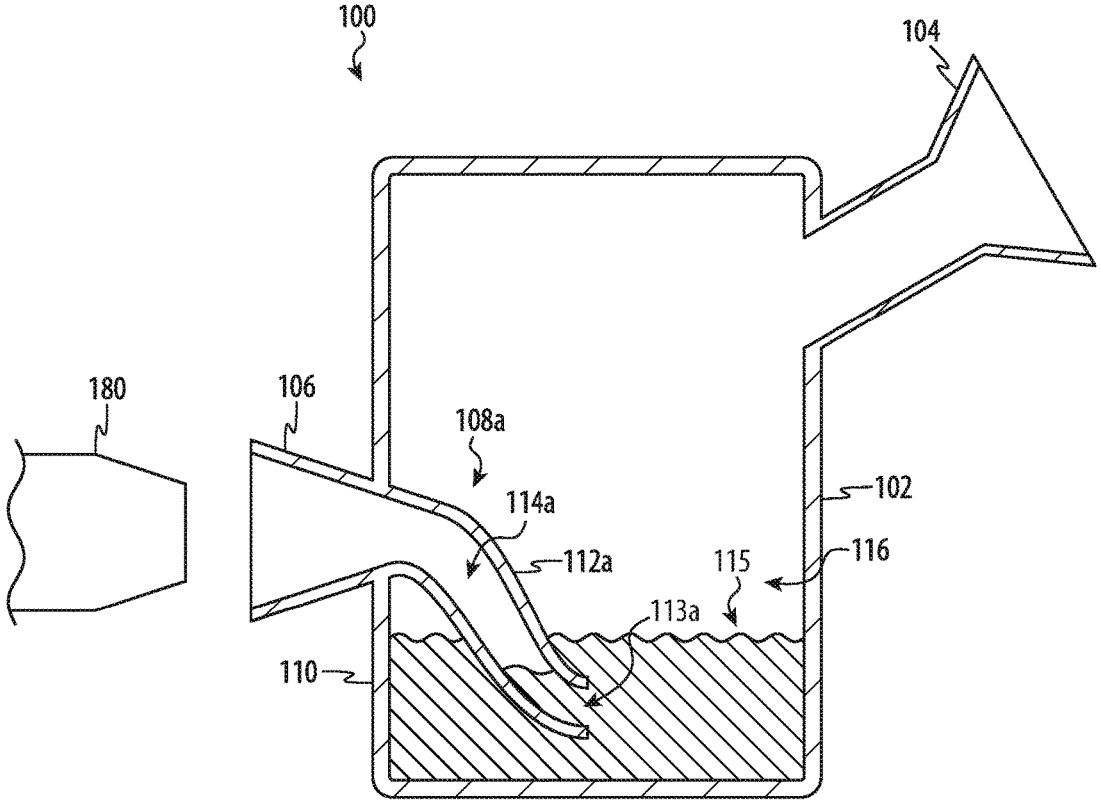
FIG. 1C depicts another example cross-sectional view of the water pipe of FIG. 1A.

FIGS. 1A-1C depict a first example of a water filter (e.g., water pipe) according to the present disclosure. As shown in FIG. 1A, a water filter 100 (e.g., a bubbler) includes a vessel body 102, a cigarette receptacle 106, and a mouthpiece 104. In many embodiments, the vessel body 102, the cigarette receptacle 106, and the mouthpiece 104 are integrally formed as a single body from a same material. In other embodiments, the components of the water filter may be separately formed.

In an example embodiment, the water filter 100 is formed from glass (e.g., borosilicate glass, lead glass, soda-lime glass, and so on). The water filter 100 may be formed from other suitable materials, such as acrylic, silicone, polymer (e.g., high-density polyethylene, polyvinyl chloride, polypropylene, and so on), metal (e.g., aluminum, steel, brass, and so on), wood, and ceramics (e.g., porcelain). In some embodiments, one or more of the vessel body 102, cigarette receptacle 106, and mouthpiece 104 are formed from distinct materials. In some embodiments, some or all of these components may be separable from one another.

The vessel body 102 is depicted as a cylinder, but may be formed in another shape suitable to form an internal cavity. For example, the vessel body 102 may be formed as a cube, a sphere, an ellipsoid (see FIGS. 2A-2C), and other geometric shapes (see, e.g., FIGS. 3-6C), including non-regular geometric shapes. Typically, the mouthpiece 104 is positioned higher on the vessel body 102 than the cigarette receptacle 106, though this is not required.

Turning to FIG. 1B, an example cross sectional view of the water filter 100 depicted in FIG. 1A, the vessel body 102 forms a water reservoir 116 (e.g., a cavity). Smoke, combusted product, or vaporized product may be processed by the water filter 100 prior to inhalation by the user. For purposes of the discussion, smoke, combusted product, vaporized product or other gaseous form of a product or substance may be referred to herein simply as smoke.

In the example of FIG. 1B, smoke enters the water reservoir through the cigarette receptacle 106, through a downtube 108, and into a lower portion of the water reservoir 116. A user typically partially fills the water reservoir 116 with a liquid up to at least a millimeter above the outlet 113 of the downtube 108, while leaving a portion of the water reservoir 116 for accumulation of smoke which has passed through the water.

The vessel body 102 may be formed such that the water reservoir 116 may hold a suitable liquid. The liquid may filter and/or cool smoke which passes through it, delivering a more pleasant and/or lower particulate smoke to a user. Smoke is typically drawn through the liquid within the water reservoir as a series of small, smoke-filled bubbles. As these bubbles pass through the liquid, the liquid may filter water soluble and heavy particulates within the smoke, such as ash. The liquid may further transfer heat from the smoke-filled bubbles, cooling the smoke prior to its delivery to the user. Additionally, the liquid may add humidity to the smoke, decreasing drying effects from inhalation of smoke. Typically, the water reservoir may be filled with water, but the water may contain other elements such as flavoring or fragrant additives. Other liquids may be placed within the water reservoir, such as fruit juices, low alcohol beverages, and so on.

The receptacle 106 is typically formed in a conical or tapered shape. The receptacle 106 may define a tapered surface, conical surface, or conical section, as described herein. In this manner, the receptacle 106 may accommodate a variety of shapes and sizes of rolled products 180 (e.g., a cigarette, cigar, cigarillo, and so on). In an example embodiment, the receptacle 106 may accommodate a rolled product 180 having diameters ranging from four millimeters to fifteen millimeters. While the particular size and shape of the rolled product 180 may vary, the rolled products typically have an elongated shape that is tapered or angled at one end.

The receptacle 106 may be configured to receive the rolled product 180. More specifically, the receptacle 106 may be configured to hold the rolled product 180 and form a seal between the rolled product 180 and the water filter 100. To facilitate retaining and sealing with the rolled product 180, the receptacle may have a tapered or conical surface 107. The tapered or conical surface 107 may define an internal conical angle θ (as measured as an interior angle along the conical surface). The conical angle θ may range between 5 and 20 degrees. In some instances, the conical angle θ may range between 10 and 15 degrees. In some instances, the conical angle θ may range between 5 and 10 degrees.

In some instances, the tapered or conical surface of the receptacle 106 may have a tapered or conical surface 107 having diameters that are particularly well suited to receive the rolled product 180. For example, the receptacle 106 may define a tapered or conical surface 107 that defines a first internal diameter 131 at the opening or first end of the receptacle 106 and a second internal diameter 132 at an internal portion or second end of the receptacle 106 that is located inward of the opening (and proximate to the vessel body 102). In some cases, the first diameter ranges between 10 mm and 20 mm and the second diameter is smaller than the first diameter and ranges between 2 mm and 9 mm. In some implementations, the first diameter ranges between 12 mm and 16 mm and the second diameter is smaller than the first diameter and ranges between 3 mm and 6 mm. The receptacle 106 may also have a length or distance 133 between the first and second end that ranges between 10 mm and 25 mm. In some cases, the length or distance 133 ranges between 10 mm and 30 mm.

The receptacle 106 may be inclined or flat with respect to a supporting flat surface. In the present example the central axis of the receptacle 106 is substantially parallel to the base of the vessel body 102. This may allow for comfortable use while limiting the amount of ash from falling into the water reservoir 102. In some embodiments, the receptacle 106 may extend upward at an angle with respect to a flat surface that supports the water filter 100 when resting on the base. The receptacle 106 may in other embodiments be coupled to the vessel body 102 at another angle.

The seal between the rolled product 180 and the receptacle 106 may be improved or facilitated by a surface treatment or surface finish of the receptacle 106. For example, an inner surface 107 of the receptacle 106, which may define at least a portion of the tapered or conical surface, may include surface features or a surface finish that facilitates forming a seal and retaining the rolled product 180 within the receptacle 106. In some examples, the inner surface 107 may have a surface texture (e.g., frosted, sandblasted, grooved). The inner surface 107 may additionally or alternatively be coated with a light adhesive or frictional material, such as rubber, urethane, or other substance having a higher coefficient of friction than the material of the receptacle 106. In other examples, the inner surface 107 may be smooth or polished.

Generally, a downtube 108 couples to the cigarette receptacle 106 such that a continuous path is provided from the cigarette into the receptacle 106, through an outer wall 110 of the vessel body 102, and into a lower portion of the water reservoir 116. The downtube 108 may be formed integral with the vessel body 102 as shown, with the outer wall 110 of the vessel body 102 and a channel 112 defining a chamber 114 through which smoke passes into the water reservoir 116. The channel 112 may be shaped as a partial cylinder molded into or otherwise coupled to the outer wall 110. In some embodiments, the downtube may extend into the water reservoir and downward at an angle from the outer wall 110 (e.g., sidewall) of the vessel body 102, as depicted in FIG. 1C.

The downtube 108 typically forms a passage extending near a bottom surface of the water reservoir 116. In operation, the water reservoir is filled with a liquid such that the water level 115 is between 1 mm and 20 mm above the outlet 113 of the downtube 108. As the rolled product 180 coupled to the receptacle 106 is combusted, the chamber 114 fills with smoke, and smoke may begin to pass through the liquid and into the portion of the water reservoir 116 above the water level 115 (e.g., an upper portion of the water reservoir). A user may further create negative pressure within the water reservoir 116 (e.g., by drawing air through the mouthpiece 104) to increase the transfer of smoke from the chamber 114 into the water reservoir 116.

The mouthpiece 104 is generally positioned on an upper portion of the vessel body 102, above the typical water level 115. Accordingly, the mouthpiece 104 is typically positioned at least 5 mm above the outlet 113 of the downtube 108. The mouthpiece 104 forms another opening through the vessel body 102 and into the water reservoir 116. As smoke enters the upper portion of the water reservoir 116, the smoke may be drawn from the water reservoir 116 through the mouthpiece 104 and inhaled by a user. Frequently, smoke accumulates within the upper portion of the water reservoir 116 for a short time prior to inhalation, which may further dissipate heat from the smoke.

FIG. 1C depicts another example cross-sectional view of the water filter of FIG. 1A. In some example embodiments, the downtube 108*a* may have a different configuration. As depicted, the downtube 108*a* may be formed integral to the vessel body 102 but not be formed along or by a portion of the outer wall 110 of the vessel body 102. Instead, the internal chamber 114*a* of the downtube 108*a* may be formed from a cylindrical or tube-shaped channel 112*a* which protrudes into the water reservoir 116.

As with the example embodiment of FIG. 1B, the downtube 108*a* depicted in FIG. 1C forms a continuous path from the receptacle 106, through the outer wall 110, and into the water reservoir 116. The outlet 113*a* of the downtube 108*a* is positioned below a typical water level 115, delivering smoke through a liquid and into the upper portion of the water reservoir 116. Furthermore, similar to as described above with respect to FIG. 1B, the water filter 100 of FIG. 1C includes a receptacle 106 that is configured to receive a rolled product 180 and may include one or more of the features described above including a specially configured tapered or conical surface.

Figure 2A:
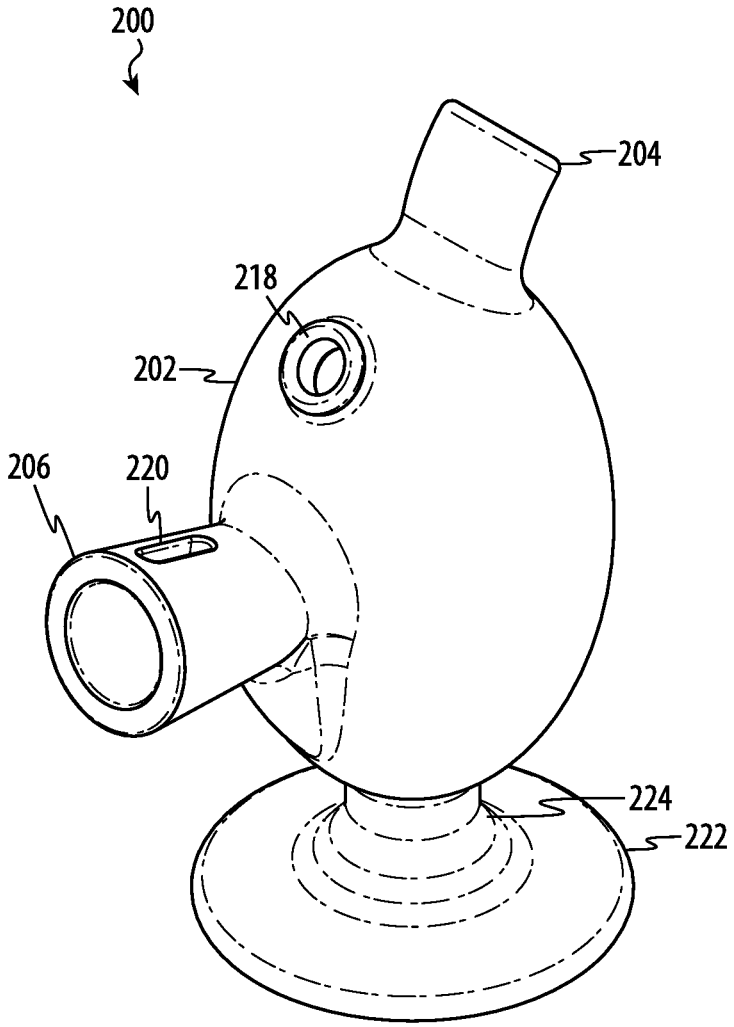
FIG. 2A depicts a second example of a water pipe, having an ellipsoid vessel body.
Figure 2B:
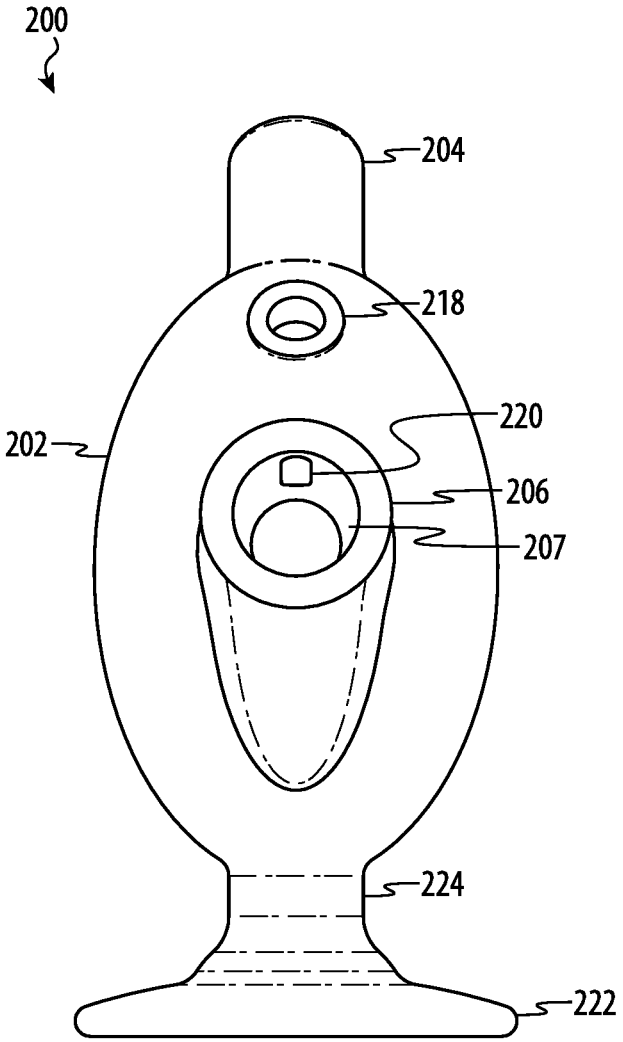
FIG. 2B depicts a front view of the water pipe of FIG. 2A.
Figure 2C:
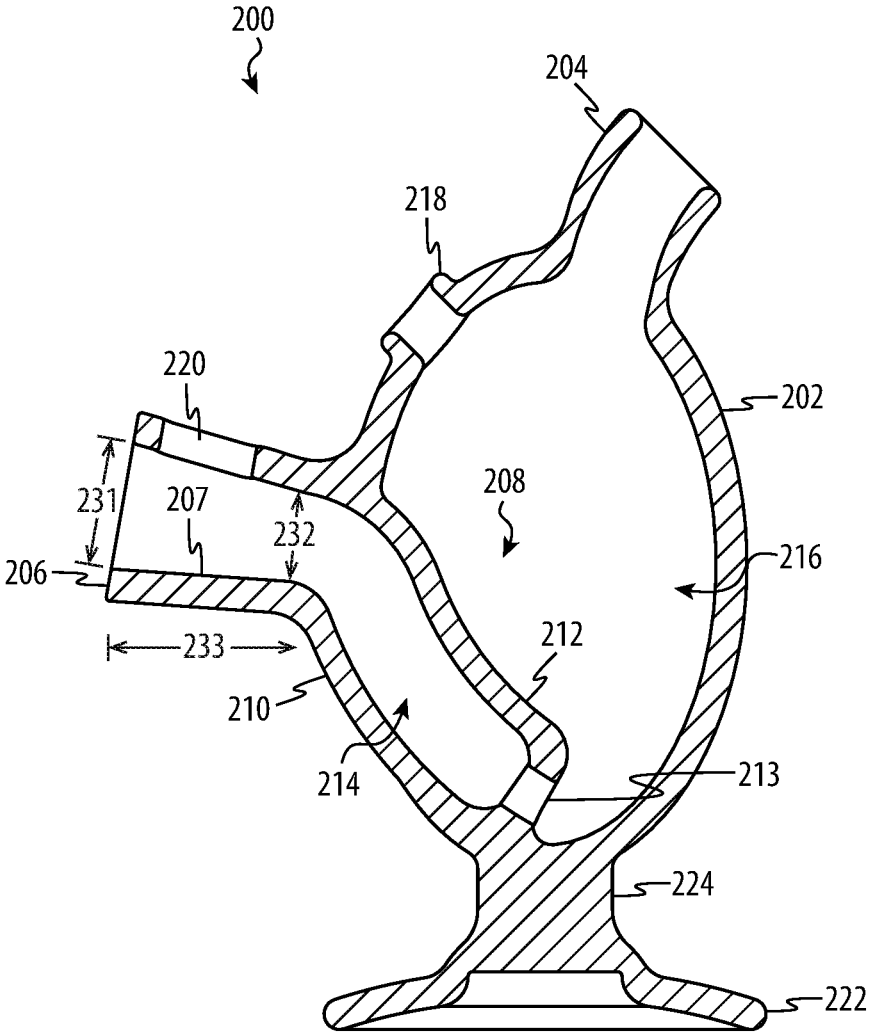
FIG. 2C depicts a cross-sectional view of the water pipe of FIG. 2A.

FIGS. 2A-2C depict a second example of a water filter according to the present disclosure. The water filter 200 includes a vessel body 202 having an ellipsoid shape. A cigarette receptacle 206 and a mouthpiece 204 are coupled to the vessel body 202. As described with respect to FIG. 1A-1C, the various components of the water filter 200 may be formed from an appropriate material, such as glass or plastic. Generally, the components of the water filter 200 are formed as a single, unitary body, though this is not necessary.

The mouthpiece 204 may be formed in a variety of shapes. For example, FIGS. 2A-2C depict the mouthpiece 204 as a tubular protrusion formed at a non-perpendicular angle near the top of the vessel body 202. In other embodiments, the mouthpiece 204 may be formed as an opening in the vessel body 202, as a flanged opening, as a tube having a flared end (e.g., a conical funnel coupled to a cylindrical tube, as depicted in FIGS. 1A-1C), or in another shape which may facilitate placement on or within a user's mouth. The mouthpiece 204 may be angled or curved, or may be placed perpendicular to the top or another surface of the vessel body 202 (such as depicted with respect to FIG. 5).

In some embodiments, the water filter 200 includes a carburation port 218. The carburation port 218 may define an opening or aperture within the vessel body 202 positioned on an upper portion of the vessel body 202 such that the carburation port 218 is above a typical water level (e.g., at least 5 mm above the outlet 213 of the downtube 208) within the reservoir 216. During operation of the water filter 202, the carburation port 218 facilitates clearing the smoke within the water reservoir 216 by providing a source for fresh air to enter the vessel body 202 into the water reservoir 216.

The carburation port 218 may be sized and shaped to allow it to be covered or sealed by a user's finger (e.g., an index finger). For example, a user may generally place a finger over the carburation port 218 to form a sealed path from the cigarette receptacle 206, through the water reservoir 216, and out through the mouthpiece 204. With this path sealed, the user may draw smoke into the water reservoir 216 by creating negative pressure within the upper portion of the water reservoir 216. Once the water reservoir 216 fills with smoke, the user may remove the finger from the carburation port 218, allowing the user to draw substantially all the smoke out of the water reservoir 216. During this process, the carburation port 218 allows the smoke to be replaced with fresh air from outside the water filter 200.

Accordingly, the carburation port 218 may be a round opening with a diameter between 2 mm and 15 mm. The carburation port 218 may be positioned such that a user's finger (e.g., an index finger) naturally rests on or near the carburation port 218 when the water filter 200 is held. In the present example, the carburation port 218 is positioned above the cigarette receptacle 206, which facilitates use of a user's index finger to operate the carburation port 218 while holding the water filter 200 with one hand. The carburation port 218 may be positioned above the cigarette receptacle 206 by a distance that is less than 20 mm. In some cases, the carburation port 218 is positioned within 15 mm or less from the cigarette receptacle 206. In some cases, the carburation port 218 is positioned at least 5 mm from the cigarette receptacle 206.

As depicted, the carburation port 218 may also include a raised flange to better facilitate a seal with an object, such as a user's finger. In some embodiments, the opening may be another shape, such as an oval, square, triangle, or another geometric shape. In some embodiments, the opening may be configured to mate with another object, such as a plug in lieu of a user's finger, in order to create a seal.

In some embodiments, the water filter 200 may further include a standing base 222, to facilitate placing the water filter 200 on a surface. The standing base 222 may be coupled to the vessel body 202 via a stem 224. In many embodiments, the standing base 222 and stem 224 are formed of the same material as the vessel body 202, and may be formed integrally with the vessel body 202. In other embodiments, the standing base 222 and/or stem 224 may be separable from the vessel body 202, and may additionally be formed from another appropriate material (e.g., glass, silicone, plastic, metal, ceramic, wood, and so on).

Turning to FIG. 2B, a front view of the water filter of FIG. 2A is depicted. The water filter 200 includes a cigarette receptacle 206 coupled to the vessel body 202, which cigarette receptacle 206 may be similar to the cigarette receptacle 106 depicted with respect to FIGS. 1A-1C. The cigarette receptacle 206 is typically formed in a conical shape to accommodate a rolled product having a variety of shapes and sizes.

In some instances, the tapered or conical surface of the receptacle 206 may have a tapered or conical surface 207 having diameters that are particularly well suited to receive the rolled product. For example, the receptacle 206 may define a tapered or conical surface 207 that defines a first internal diameter 231 at the opening or first end of the receptacle 206 and a second internal diameter 232 at an internal portion or second end of the receptacle 106. The internal portion or second end of the receptacle may be located inward of the opening (and proximate to the vessel body 202). In some cases, the first diameter ranges between 10 mm and 20 mm and the second diameter is smaller than the first diameter and ranges between 2 mm and 9 mm. In some implementations, the first diameter ranges between 12 mm and 16 mm and the second diameter is smaller than the first diameter and ranges between 3 mm and 6 mm. The receptacle 206 may also have a length or distance 233 between the first and second end that ranges between 10 mm and 30 mm. In some cases, the length or distance 233 ranges between 15 mm and 25 mm.

As discussed above, the inner surface 207 may include features to facilitate retaining a cigarette within the cigarette receptacle 206 and/or forming a seal between the cigarette and the receptacle 206. For example, the inner surface 207 may be textured or coated with a material which increases friction between the cigarette receptacle 206 and a cigarette. In some cases, the inner surface 207 includes grooves or a bead blasted or textured finish to provide a suitable interface between the cigarette receptacle 206 and a cigarette.

In some embodiments, the cigarette receptacle 206 may be formed with a cleaning port 220. As a cigarette is combusted, ash and other debris and particulates may accumulate within the cigarette receptacle 206, the downtube 208, and/or the water reservoir. The cleaning port 220 may accommodate the insertion of cleaning implements to clear the cigarette receptacle 206, the downtube 208, and/or the water reservoir of debris.

Turning to FIG. 2C, a cross sectional view of the water filter in FIG. 2A is depicted. Similar to the embodiment describe above with respect to FIG. 1B, the vessel body 202 forms a water reservoir 216. The vessel body 202 is formed by an outer wall 210. Smoke enters the water reservoir through the cigarette receptacle 206, through a downtube 208, and into a lower portion of the water reservoir 216. A user typically partially fills the water reservoir 216 with a liquid to a point above the outlet 213 of the downtube 208, but well below the mouthpiece 204 and the carburation port 218. Smoke may accumulate in the portion of the water reservoir 216 above the liquid.

Generally, a downtube 208 couples to the cigarette receptacle 206 such that a continuous path is provided from the cigarette into the receptacle 206, through the outer wall 210 of the vessel body 202, and into a lower portion of the water reservoir 216. In many embodiments, the downtube 208 may be formed integral with the vessel body 202, with the outer wall 210 of the vessel body and a channel 212 coupled to the outer wall 210 defining a chamber 214 through which smoke passes into the water reservoir 216. In some embodiments, the downtube 208 may not be formed with the outer wall 210, but may instead be formed from a cylindrical channel which protrudes into the water reservoir 216 (similar to the downtube 108*a* depicted with respect to FIG. 1C).

The downtube 208 extends near a bottom surface of the water reservoir 216, such that the outlet 213 of the downtube 208 would be below a typical water level during operation of the water filter 200. The downtube 208 may deliver smoke under the surface of the liquid in the water reservoir in a manner similar to that described above with respect to FIG. 1B.

Figure 3:
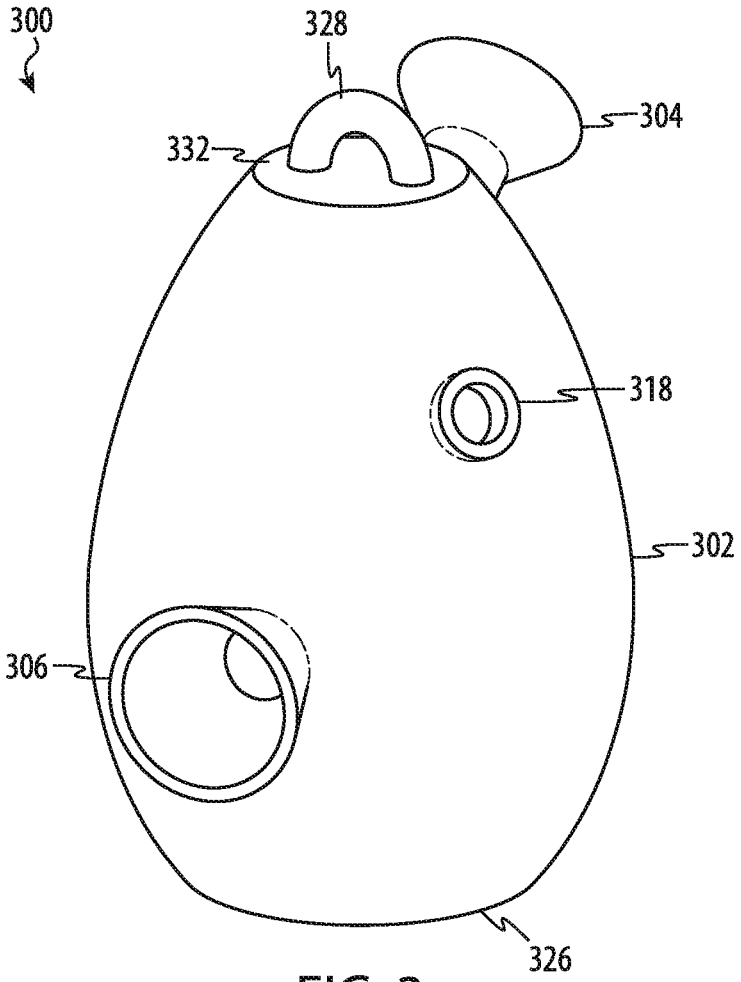
FIG. 3 depicts another example of a water pipe, having a pear-shaped vessel body.

As FIGS. 3-6C illustrate, a water filter according to the present disclosure may have a variety of geometric shapes and features. For example, FIG. 3 depicts a third example of a water filter according to the present disclosure. The water filter 300 includes a vessel body 302 having a pear shape. The pear-shaped vessel body 302 may be partially ellipsoid with a larger diameter lower portion. The pear-shaped vessel body 302 may also have a flattened bottom surface 326, such that a standing base may be omitted.

The water filter 300 further includes a cigarette receptacle 306 and a mouthpiece 304 coupled to the vessel body 302, providing a path for smoke to pass from a cigarette, into the cigarette receptacle 306, through the vessel body 302, and out through the mouthpiece 304. The cigarette receptacle 306 may be similar to the receptacles 106, 206 as described above with respect to FIGS. 1A-2C. The cigarette receptacle 306 may alternatively be shaped differently, such as a tubular shape or a combination of a tube and a cone to accommodate various sizes and shapes of rolled products.

The water filter 300 may further include a carburation port 318 in the vessel body 302. Where the carburation port 218 depicted in FIGS. 2A-2C was positioned directly above the cigarette receptacle 206, the carburation port 318 may be positioned in other locations, such as illustrated in FIG. 3. The carburation port 318 may be positioned above a typical water level (e.g., at least 5 mm above the smoke outlet from the cigarette receptacle 306) in a location at or near where a typical user may place a finger while holding the water filter 300.

In many embodiments, the water filter 300 is small enough to fit into a user's hand or otherwise be easily transported. In these and other embodiments, the water filter 300 may include an attachment point, such as an eyelet 328, for attachment to a necklace, bracelet, keychain, or other object for ease of carrying. In some embodiments, the eyelet 328 may be attached to a top surface 332 of the vessel body 302, while in other embodiments the eyelet 328 may be attached at a different location. In some embodiments, the attachment point may be a rod, bar, hook, or similar feature to facilitate carrying or attachment to another object.

Figure 4:
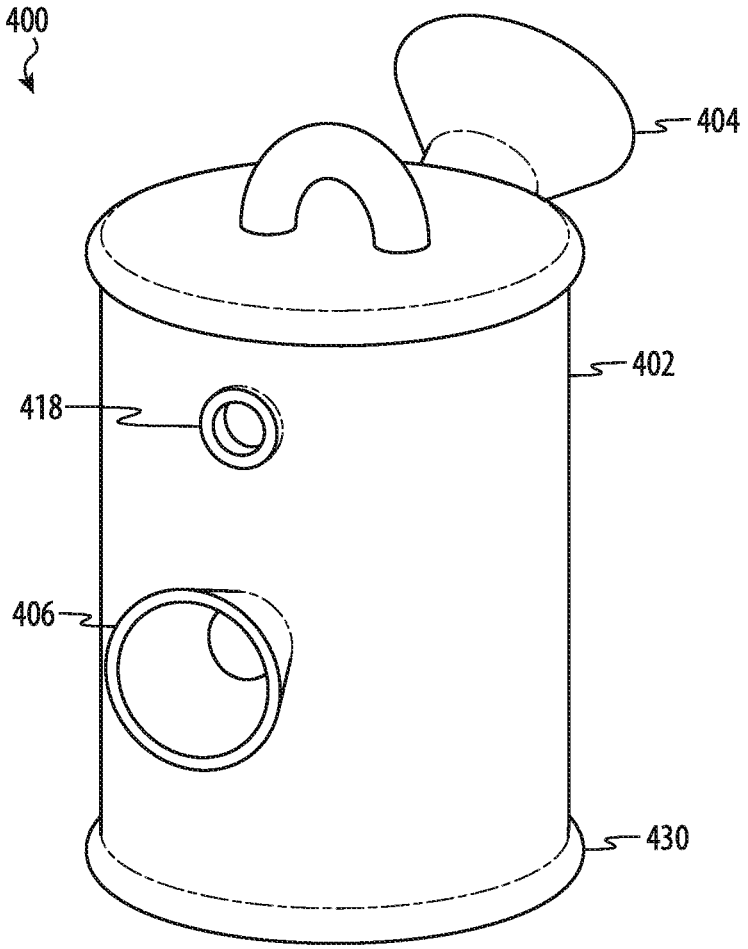
FIG. 4 depicts another example of a water pipe, having a barrel or cylindrical-shaped vessel body.

FIG. 4 depicts a fourth example of a water filter according to the present disclosure. The water filter 400 includes a vessel body 402, with a cigarette receptacle 406 and a mouthpiece 404 coupled to the vessel body 402. The vessel body 402 may be shaped as a cylinder or barrel. The barrel-shaped vessel body 402 may further include decorative features 430. In some embodiments, such decorative features 430 may be omitted. Embodiments having other vessel body shapes may also include decorative features 430.

The water filter 400 may include some or all of the features and functions described above with respect to FIGS. 1A-3. For example, the cigarette receptacle 406 may hold a rolled product, such as a cigarette, and smoke from the cigarette may be delivered into the vessel body 402 and out through the mouthpiece 404. A carburation port 418 may facilitate clearing smoke accumulated in the vessel body 402.

Figure 5:
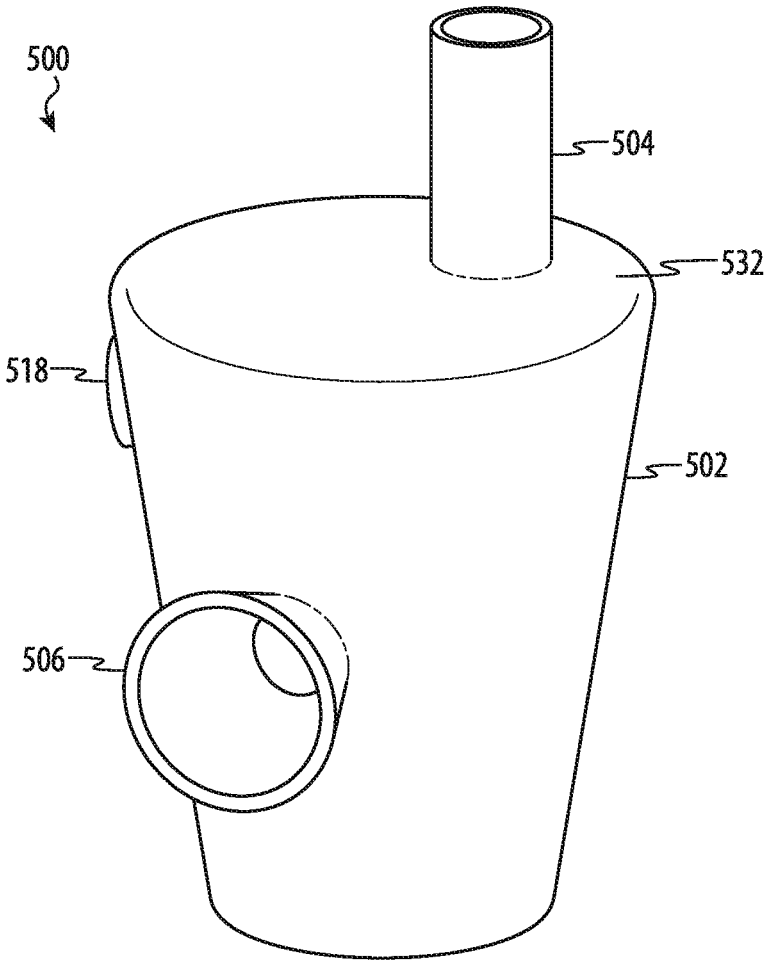
FIG. 5 depicts another example of a water pipe, having a conical frustum-shaped body.

FIG. 5 depicts a fifth example of a water filter according to the present disclosure. The water filter 500 includes a vessel body 502, with a cigarette receptacle 506 and a mouthpiece 504 coupled to the vessel body 502. The vessel body 502 may be shaped as a conical frustum, having a diameter which changes along its length, similar to many ceramic pots.

The water filter 500 may include some or all of the features and functions described above with respect to FIGS. 1A-4. For example, the cigarette receptacle 506 may hold a rolled cigarette and smoke from the cigarette may be delivered into the vessel body 502 and out through the mouthpiece 504. As depicted, the mouthpiece may be formed as a long cylinder coupled perpendicular to a top surface 532 of the vessel body 502. A carburation port 518 may facilitate clearing smoke accumulated in the vessel body 502.

Figure 6A:
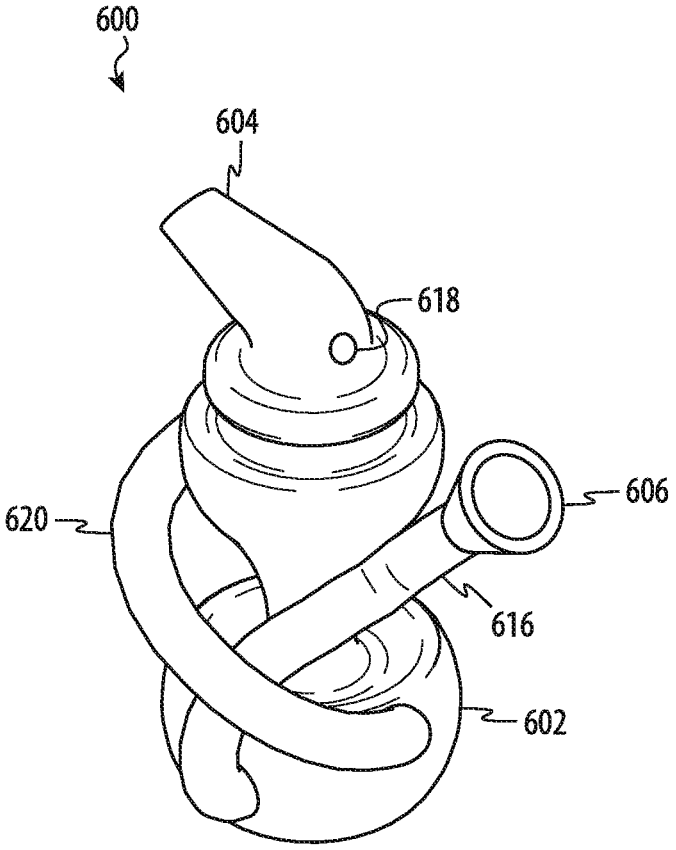
FIGS. 6A-6C depict another example of a water pipe having an alternative receptacle configuration.
Figure 6B:
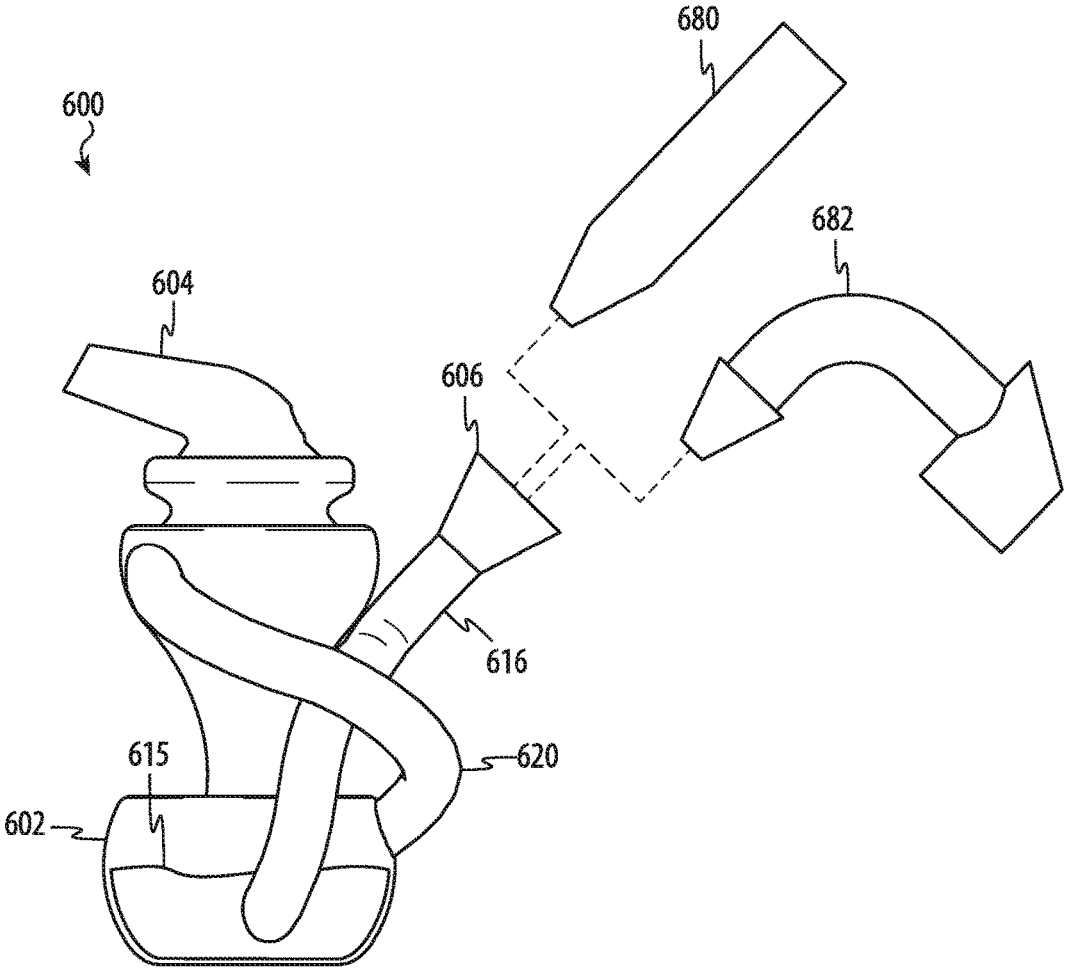
Figure 6C:
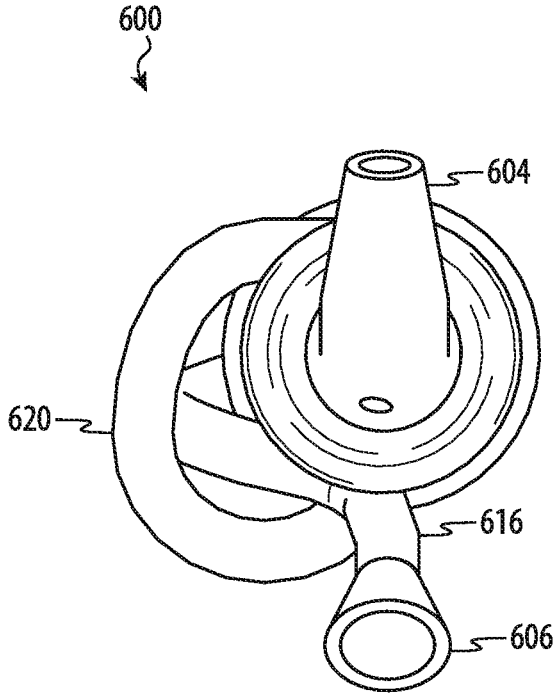

FIGS. 6A-6C depict another example of a water filter according to the present disclosure. The water filter 600 includes a vessel body 602, with a cigarette receptacle 606 and a mouthpiece 604 coupled to the vessel body 602. The vessel body 602 also defines a carburation port 618 positioned along an upper portion of the vessel body 602. The vessel body 602 may have a stylistic shape with a contoured surface that resembles a hat or other object. The vessel body 602 defines lower and upper cavities that may be separated by a wall or section or may be coupled by an open section or chamber.

In this example, the vessel body 602 is integrally formed with a first tube 616 that couples the receptacle 606 to the internal cavity (e.g., the lower cavity) of the vessel body 602. The vessel body 602 is also integrally formed with a second tube 620 that couples a lower portion or the lower cavity of the vessel body 602 with an upper portion or the upper cavity of the vessel body 602. As shown in FIGS. 6A-6C, the first tube 616 and the second tube 620 may twist around the vessel body 602 and intertwine with each other.

As shown in FIG. 6B, the first tube 616 extends and twists from a front region of the water pipe 600 to a side of the vessel body 602. The second tube 620 extends and twists from a front of the lower portion of the vessel body 602 to a side of the upper portion of the vessel body 602. Also as shown in FIG. 6B, the first tube 616 couples to the lower portion of the vessel body 602 to define an outlet that is configured to be submerged below the water reservoir 615. The second tube 620 couples to the lower portion of the vessel body 602 to define an inlet that is configured to be above the water reservoir 615. This inlet and outlet configuration, in combination with the twisted configuration of the first tube 616 and the second tube 620 helps prevent liquid from the water reservoir 615 from being spilled when the water pipe 600 is tipped or handled.

As shown in FIG. 6B, the receptacle 606 of the water pipe 600 may be configured to receive a rolled product 680. As described with respect to the other embodiments described herein, the receptacle 606 may define a conical or tapered surface that is configured to form a seal between the rolled product 680 and the receptacle 606. Also as shown in FIG. 6B, the receptacle 606 may be configured to receive an accessory 682. The accessory 682 may be configured to receive a combustible product, such as a combustible leaf product or combustible oil product.

The water filter 600 may include some or all of the features and functions described above with respect to FIGS. 1A-5. For example, the cigarette receptacle 606 may hold a rolled cigarette and smoke from the cigarette may be delivered into the vessel body 602 and out through the mouthpiece 604. As depicted, the mouthpiece may be formed as a contoured shape that extends from an upper portion of the vessel body 602. A carburation port 618 may facilitate clearing smoke accumulated in the vessel body 602.

It should be generally understood from the above description that the present disclosure is not limited to the particular shapes, sizes, and features described above with respect to FIGS. 1A-6C. For example, a variety of vessel body shapes, cigarette receptacle shapes, and mouthpiece shapes are contemplated within the present disclosure. A variety of lengths and shapes of downtubes are also contemplated, with the above examples given for illustrative purposes. In addition, embodiments of the present disclosure may omit or add features such as those described above.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed is:

1. A water filter, comprising:

a vessel body including an outer wall defining an internal cavity configured to retain a liquid;

a mouthpiece integrally formed and positioned on an upper portion of the vessel body and defining an opening through the outer wall and into the internal cavity;

a receptacle integrally formed with and extending outward from the outer wall of the vessel body and configured to hold a rolled product; and a downtube extending from the receptacle and into the internal cavity, the downtube having a chamber that is defined, in part, by the outer wall of the vessel body, wherein:

the downtube includes an outlet that is submerged in the liquid retained in the vessel body and is configured to direct combusted or vaporized material from the rolled product into the retained liquid.

2. The water filter of claim 1, wherein:

the receptacle defines a conical surface; and the conical surface is configured to form a seal between the rolled product and the receptacle.

3. The water filter of claim 2, wherein the conical surface has an interior angle that ranges between 5 and 10 degrees.

4. The water filter of claim 1, wherein:

the receptacle defines a tapered surface having a first diameter at an outer end and a second diameter at an inner end;

the first diameter ranges between 10 mm and 20 mm;

the second diameter is less than the first diameter and ranges between 2 mm and 9 mm; and a distance between the outer end and the inner end is approximately 10 mm to 25 mm.

5. The water filter of claim 4, wherein the tapered surface has a sand blasted surface finish that facilitates a seal between the rolled product and the receptacle.

6. The water filter of claim 1, wherein:

the water filter further comprises a base configured to support the water filter on a flat surface; and the receptacle extends upward at an angle with respect to the flat surface.

7. The water filter of claim 1, wherein the vessel body, the mouthpiece, and the receptacle are integrally formed from a glass material or a silicone material.

8. The water filter of claim 1, wherein:

a carburation port is positioned above the receptacle by a distance that is less than 20 mm.

9. The water filter of claim 1, wherein:

the downtube is formed from a glass material;

the vessel body is formed from the glass material; and the downtube is integrally formed with the vessel body.

10. A water filter, comprising:

a vessel body having an outer wall defining an internal cavity configured to hold water in a lower portion of the vessel body;

a mouthpiece extending from the outer wall along an upper portion of the vessel body and defining an opening that extends into the internal cavity;

a receptacle extending from the outer wall of the vessel body and configured to receive a rolled product;

a carburation port defined within the outer wall and configured to be blocked by a finger of the user's hand when held; and a downtube coupled to the receptacle and having an outlet that is configured to be submerged by the water in the internal cavity wherein:

the downtube comprises a chamber that is configured to receive combusted or vaporized product from the rolled product that passes through the receptacle;

the chamber is defined, in part, by the outer wall of the vessel body; and the chamber includes a chamber wall that defines the outlet that is submerged by the water in the lower portion of the vessel body.

11. The water filter of claim 10, wherein the receptacle defines a conical section that is configured to receive the rolled product.

12. The water filter of claim 11, wherein:

the conical section defines a first internal diameter at an opening of the receptacle;

the conical section defines a second internal diameter located inward of the opening of the receptacle proximate to the vessel body; and the first internal diameter ranges between 10 mm and 20 mm; and the second internal diameter is less than the first internal diameter and ranges between 2 mm and 9 mm.

13. The water filter of claim 11, wherein the conical section includes a textured surface configured to facilitate a seal between the rolled product and the conical section.

14. The water filter of claim 11, wherein the conical section has an interior angle that ranges between 5 and 10 degrees.

15. A water filter, comprising:

a glass vessel body having a sidewall defining an internal cavity that is configured to hold water;

a mouthpiece extending from the sidewall and defining an opening into an upper portion of the internal cavity;

a receptacle extending from the sidewall and defining a tapered surface that is configured to form a seal between a rolled product and the receptacle; and a downtube extending into the internal cavity and having an internal passage that is configured to transfer smoke or vaporized product from the receptacle to the water, wherein:

the internal passage is defined, in part, by a portion of the sidewall of the glass vessel body;

the glass vessel body defines a carburation port along the sidewall; and the carburation port is configured to be blocked by a digit of the user's hand when held.

16. The water filter of claim 15, wherein:

the rolled product includes an end portion having a tapered angle; and the tapered surface of the receptacle has an internal angle that is greater than the tapered angle of the rolled product.

17. The water filter of claim 15, wherein the tapered surface defines a first internal diameter ranging between 10 mm and 20 mm and a second internal diameter ranging between 2 mm and 9 mm.

18. The water filter of claim 15, wherein the carburation port is positioned between the receptacle and the mouthpiece at a distance of less than 20 mm from the receptacle.

* * * * *